US009713740B1

(12) United States Patent
Chen

(10) Patent No.: US 9,713,740 B1
(45) Date of Patent: Jul. 25, 2017

(54) ABDOMINAL EXERCISING DEVICE

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 0 days.

(21) Appl. No.: 15/154,075

(22) Filed: May 13, 2016

(51) Int. Cl.
*A63B 21/00* (2006.01)
*A63B 23/02* (2006.01)
*A63B 21/02* (2006.01)

(52) U.S. Cl.
CPC ..... *A63B 23/0211* (2013.01); *A63B 21/023* (2013.01)

(58) Field of Classification Search
USPC ..... 482/1–148
See application file for complete search history.

(56) References Cited

U.S. PATENT DOCUMENTS 6,220,995 B1 4/2001 Chen
6,592,500 B1 7/2003 McBride et al.
6,743,159 B1 6/2004 Taylor et al.
7,101,328 B2 9/2006 Chiu
7,341,547 B2 3/2008 Liao
7,381,171 B2 6/2008 Chen
8,002,683 B1 8/2011 Nayebdadash
8,764,617 B2 7/2014 Teeter
8,790,227 B2 7/2014 Meister et al.
8,900,105 B2 12/2014 Zhu
9,238,157 B2 1/2016 Chuang et al.
9,278,244 B2 * 3/2016 Chuang ..... A63B 21/055
2007/0135281 A1 * 6/2007 Liao ..... A63B 21/0004 482/140

* cited by examiner

*Primary Examiner* — Stephen Crow
(74) *Attorney, Agent, or Firm* — Charles E. Baxley

(57) ABSTRACT

An abdominal exercising device includes a base supporting member having a seat element for supporting a user, two handles each having a lower portion rotatably attached to the base supporting member with a pivot shaft, two spring biasing members engaged between the handles and the base supporting member for biasing the handles relative to the base supporting member, and two adjusting members are engaged with the beams of the base supporting member respectively and engageable with the spring biasing members for adjusting the spring biasing members relative to the base supporting member and the handles and for adjusting the spring biasing force to the handles and for users of different strengths.

7 Claims, 5 Drawing Sheets

ABDOMINAL EXERCISING DEVICE

BACKGROUND OF THE INVENTION

1. Field of the Invention

The present invention relates to an abdominal exercising device, and more particularly to an abdominal exercising device including a structure or configuration for people to comfortably rehabilitate or exercise their abdominal portion or other muscle groups and including a simplified structure or configuration that may be made or manufactured with a simplified manufacturing procedure and a decreased or reduced manufacturing cost.

2. Description of the Prior Art

Various kinds of typical rehabilitation or abdominal exercising devices have been developed and provided for people to conduct or operate various kinds of exercises, and comprise a large number of the exercising devices for training or exercising their abdominal portion or other muscle groups.

For example, U.S. Pat. No. 6,220,995 to Chen, U.S. Pat. No. 6,592,500 to McBride et al., U.S. Pat. No. 6,743,159 to Taylor et al., U.S. Pat. No. 7,101,328 to Chiu, U.S. Pat. No. 7,341,547 to Liao, U.S. Pat. No. 7,381,171 to Chen, U.S. Pat. No. 8,002,683 to Nayebdadash, U.S. Pat. No. 8,764,617 to Teeter, U.S. Pat. No. 8,790,227 to Meister et al., U.S. Pat. No. 8,900,105 to Zhu, U.S. Pat. No. 9,278,244 to Chuang et al., and U.S. Pat. No. 9,238,157 to Chuang et al. disclose several of the typical rehabilitation or abdominal exercising devices each comprising an exercising equipment or arrangement or the like disposed or attached or mounted or secured or formed or provided on the base supporting member for being actuated or operated by the user to train or exercise their abdominal portion or other muscle groups.

However, the typical rehabilitation or exercising devices comprise a complicated structure or configuration that may not be made or manufactured and may not be used for the disable persons to comfortably rehabilitate or exercise their abdominal portion or other muscle groups.

The present invention has arisen to mitigate and/or obviate the afore-described disadvantages of the conventional rehabilitation or abdominal exercising devices.

SUMMARY OF THE INVENTION

The primary objective of the present invention is to provide an abdominal exercising device including a structure or configuration for the disable persons to comfortably rehabilitate or exercise their abdominal portion or other muscle groups and including a simplified structure or configuration that may be made or manufactured with a simplified manufacturing procedure and a decreased manufacturing cost.

In accordance with one aspect of the invention, there is provided an abdominal exercising device comprising a base supporting member including a seat element for supporting a user, and including two beams provided on side portions, two handles each including a lower portion rotatably attached to the base supporting member with a pivot shaft for allowing the handles to be rotated relative to the base supporting member, two spring biasing members engaged with and engaged between the handles and the base supporting member for applying a spring biasing force to the handles and for resisting a rotational movement of the handles relative to the base supporting member, and two adjusting members engaged with the beams of the base supporting member respectively and engageable with the spring biasing members for adjusting the spring biasing members relative to the base supporting member and the handles and thus for allowing the spring biasing members to apply different spring biasing forces to the handles and thus for allowing the users of different sizes or dimensions or heights to suitably actuate or operate the handles relative to the base supporting member.

The spring biasing members each include a first leg engaged with the handle and a second leg extended into the beams of the base supporting member. The base supporting member includes two followers slidably engaged in the beams and engaged with the second legs of the spring biasing members respectively, the adjusting members are engaged with the followers respectively for suitably engaging with the second legs of the spring biasing members and for suitably forcing and actuating the second legs of the spring biasing members to move relative to the base supporting member.

The followers each include at least one guiding member attached to the followers for guiding and limiting the followers to slide or move relative to the beams respectively and for preventing the follower from being pivoted or rotated relative to the beam. The beams of the base supporting member each include a groove formed therein for slidably receiving and engaging with the respective second leg of the spring biasing members and for guiding and limiting the second leg of the spring biasing member to move relative to the beam.

The adjusting members each include a knob provided thereon for rotating the adjusting member relative to the beam. The beams of the base supporting member each include a cap provided thereon, and the adjusting members are threaded and engaged with the caps of the beams of the base supporting member respectively for engaging with the followers.

The beams of the base supporting member each include two ears attached to the beam and extended beyond the beam for supporting the pivot shaft thereon, and the bottom portion of the handle is rotatably attached to the base supporting member with the pivot shaft. A base frame is adjustably supported on the base supporting member for adjustably supporting the seat element to the base supporting member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
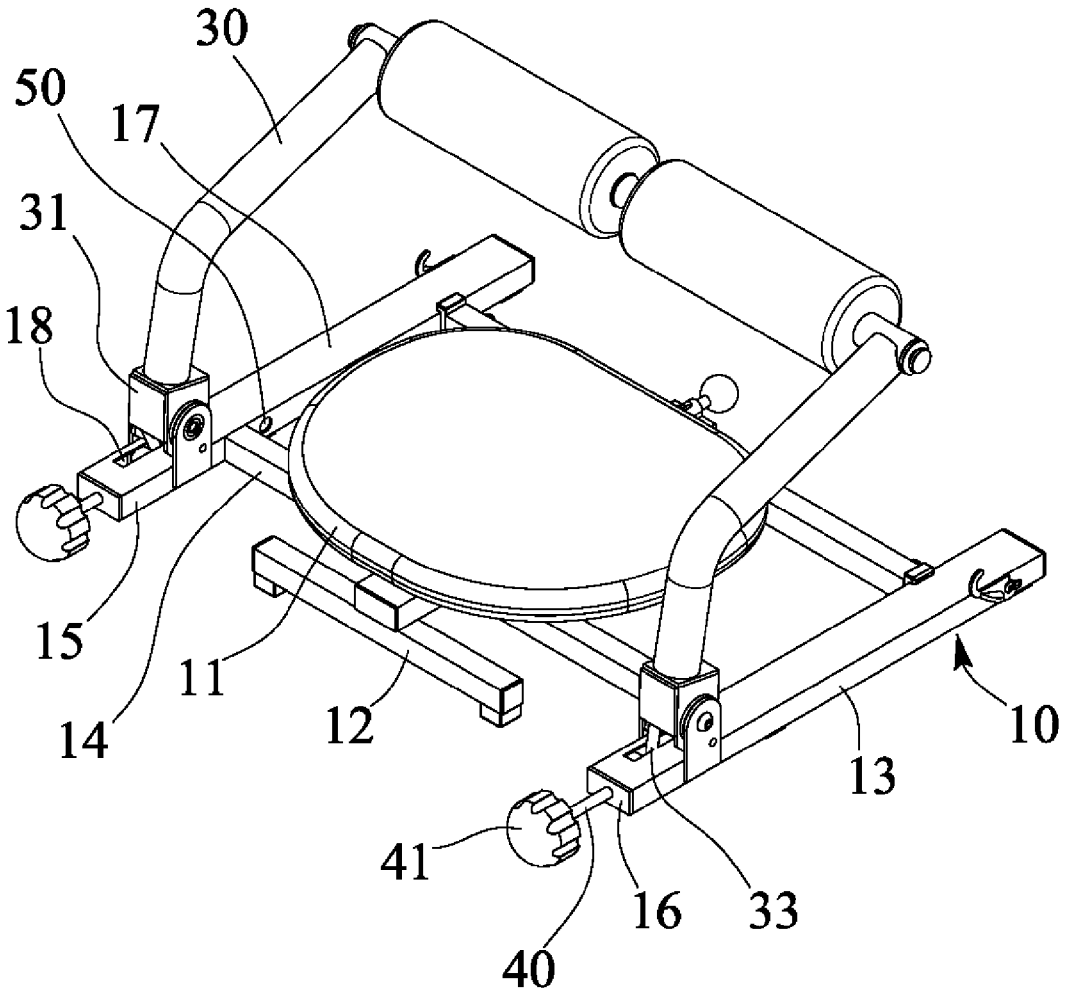
FIG. 1 is a perspective view of an abdominal exercising device in accordance with the present invention.

Referring to the drawings, and initially to FIGS. 1-4, an abdominal exercising device in accordance with the present invention is particularly provided for people to comfortably rehabilitate or exercise their abdominal portion or other muscle groups, and comprises a base supporting member 10 including a chair member or seat cushion or pad or element 11 formed or provided or disposed on a middle or intermediate portion of the base supporting member 10 for supporting a user thereon, for example, a base frame 12 is movably or adjustably disposed or supported on the base supporting member 10 for supporting the seat element 11. The base supporting member 10 includes one or more (such as two) bars or beams 13 disposed or provided on two side portions of the base supporting member 10 and attached or mounted or secured to one or more lateral levers or bars 14 for forming or defining a stable base supporting structure or configuration.

The beams 13 each include one or first end or front portion 15 having a front cover or cap 16 formed or provided thereon, and each include an upper panel or wall 17 having a channel or groove 18 formed therein and located in the front portion 15 of the beams 13, and each include a bore or chamber or compartment 19 formed therein (FIGS. 2, 4-5) and communicating with the groove 18 of the upper wall 17 of the beam 13. A rod or sliding member or follower 20 is slidably received or engaged in the compartment 19 of each of the beams 13, and one or more (such as two) flaps or guiding members 21 are attached or mounted or secured to the follower 20, such as attached to the two side portions of the follower 20 for guiding and limiting the follower 20 to smoothly slide or move relative to and along the compartment 19 of the respective beam 13, and for preventing the follower 20 from being pivoted or rotated relative to the beam 13.

The base supporting member 10 further includes a pair of flaps or ears 22 attached or mounted or secured to the front portion 15 of each of the beams 13, and extended upwardly beyond the upper wall 17 of the beam 13 for supporting a pivot pin or shaft 23 thereon. It is preferable that the pivot shafts 23 are parallel to the lateral bars 14 and perpendicular to the groove 18 of the upper wall 17 of the beam 13. One or more (such as two) arms or arm rests or hand grips or handles 30 each include a lower or bottom portion 31 attached or mounted or secured to the base supporting member 10 with the pivot shaft 23 for allowing the handles 30 to be pivoted or rotated forwardly and rearwardly relative to the base supporting member 10. One or more (such as two) spring biasing members 33 are attached or mounted or secured to the base supporting member 10 and contacted or engaged with the handles 30 and the base supporting member 10.

Figure 2:
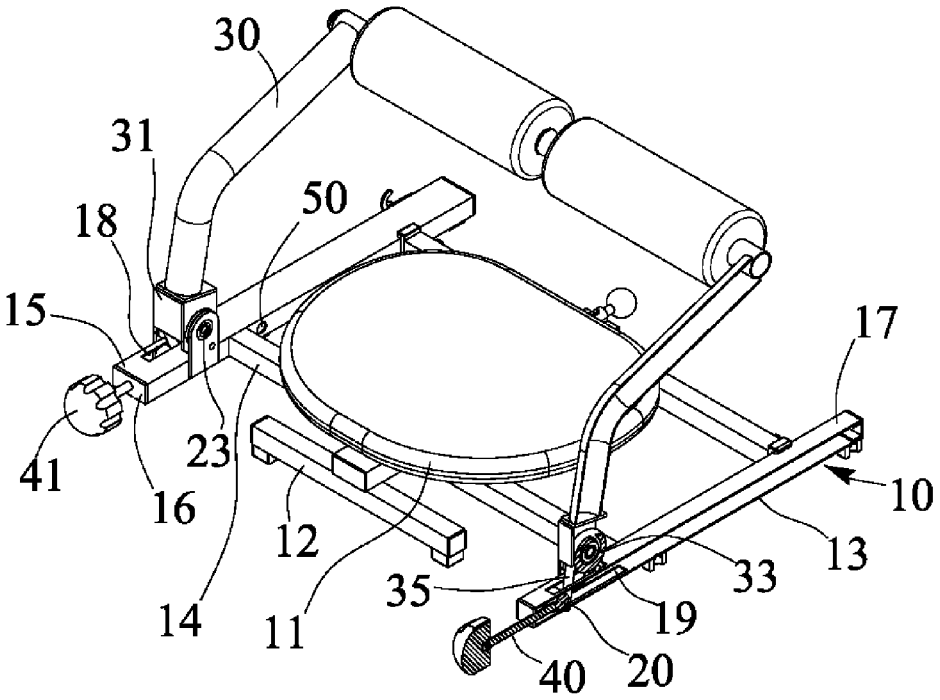
FIG. 2 is another perspective view of the abdominal exercising device, similar to FIG. 1, in which a portion of the abdominal exercising device has been cut off for showing the inner structure of the abdominal exercising device.
Figure 3:
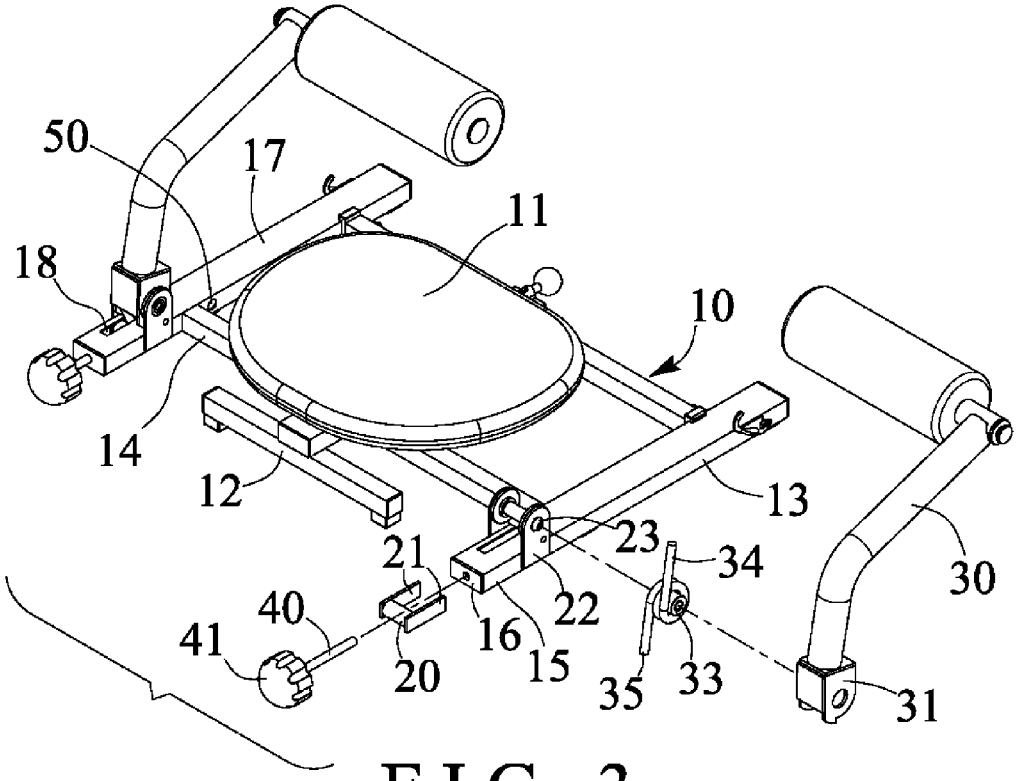
FIG. 3 is a partial exploded view of the abdominal exercising device.

For example, the spring biasing members 33 are selected from coil spring biasing members 33 and attached or mounted or engaged with the pivot shaft 23, and each include one or first leg 34 contacted or engaged with the handles 30 and another or second leg 35 contacted or engaged with or extended into the base supporting member 10, for applying a spring biasing force against or between the handles 30 and the base supporting member 10 and for resisting the rotational movement between the handles 30 and the base supporting member 10 or the like. The other or second legs 35 of the spring biasing members 33 are engaged with or into the groove 18 of the upper wall 17 of the beam 13 and contacted or engaged with the followers 20 respectively for allowing the other or second legs 35 of the spring biasing members 33 to be forced and moved forwardly and rearwardly relative to the base supporting member 10 with the followers 20 respectively (FIGS. 2, 4-5).

One or more (such as two) screws or bolts or adjusting members 40 are threaded or engaged with the caps 16 of the beams 13 of the base supporting member 10 respectively and engageable into the compartments 19 of the beams 13 respectively for contacting or engaging with the followers 20 respectively, and thus for forcing and moving the other or second legs 35 of the spring biasing members 33 forwardly and rearwardly relative to the base supporting member 10 respectively. The adjusting members 40 each include a hand grip of knob 41 formed or provided thereon for pivoting or rotating or threading the adjusting members 40 relative to the caps 16 of the beams 13 of the base supporting member 10 respectively, and for forcing and moving the adjusting members 40 to force and move the other or second legs 35 of the spring biasing members 33 forwardly and rearwardly relative to the base supporting member 10 respectively.

Figure 4:
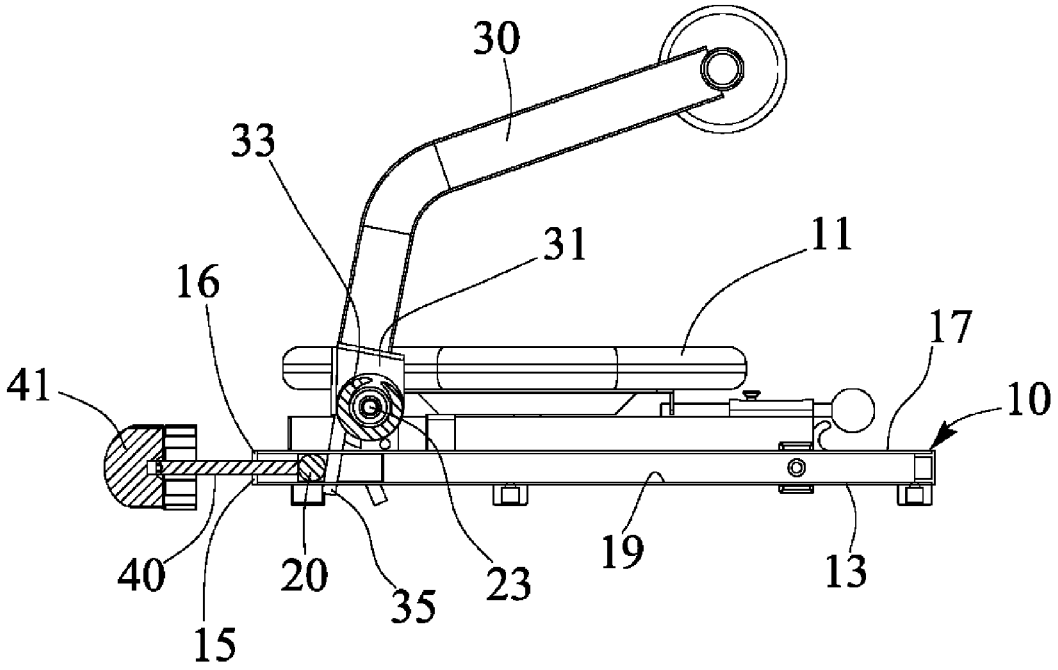
FIG. 4 is a side plan schematic view of the abdominal exercising device, in which a portion of the abdominal exercising device has been cut off for showing the inner structure of the abdominal exercising device.
Figure 5:
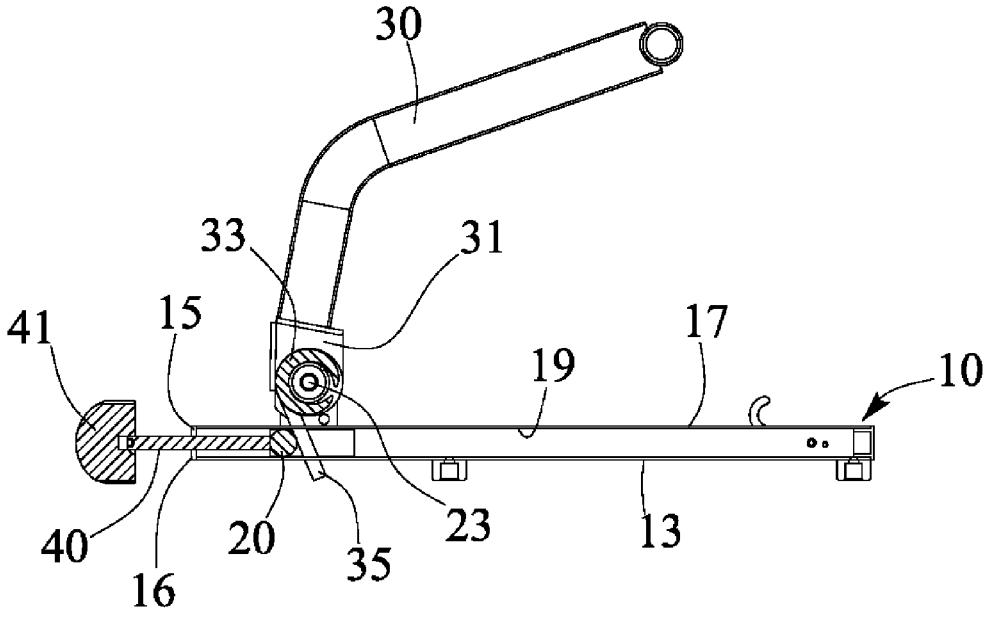
FIG. 5 is another side plan schematic view similar to FIG. 4, illustrating the operation of the abdominal exercising device.
Figure 6:
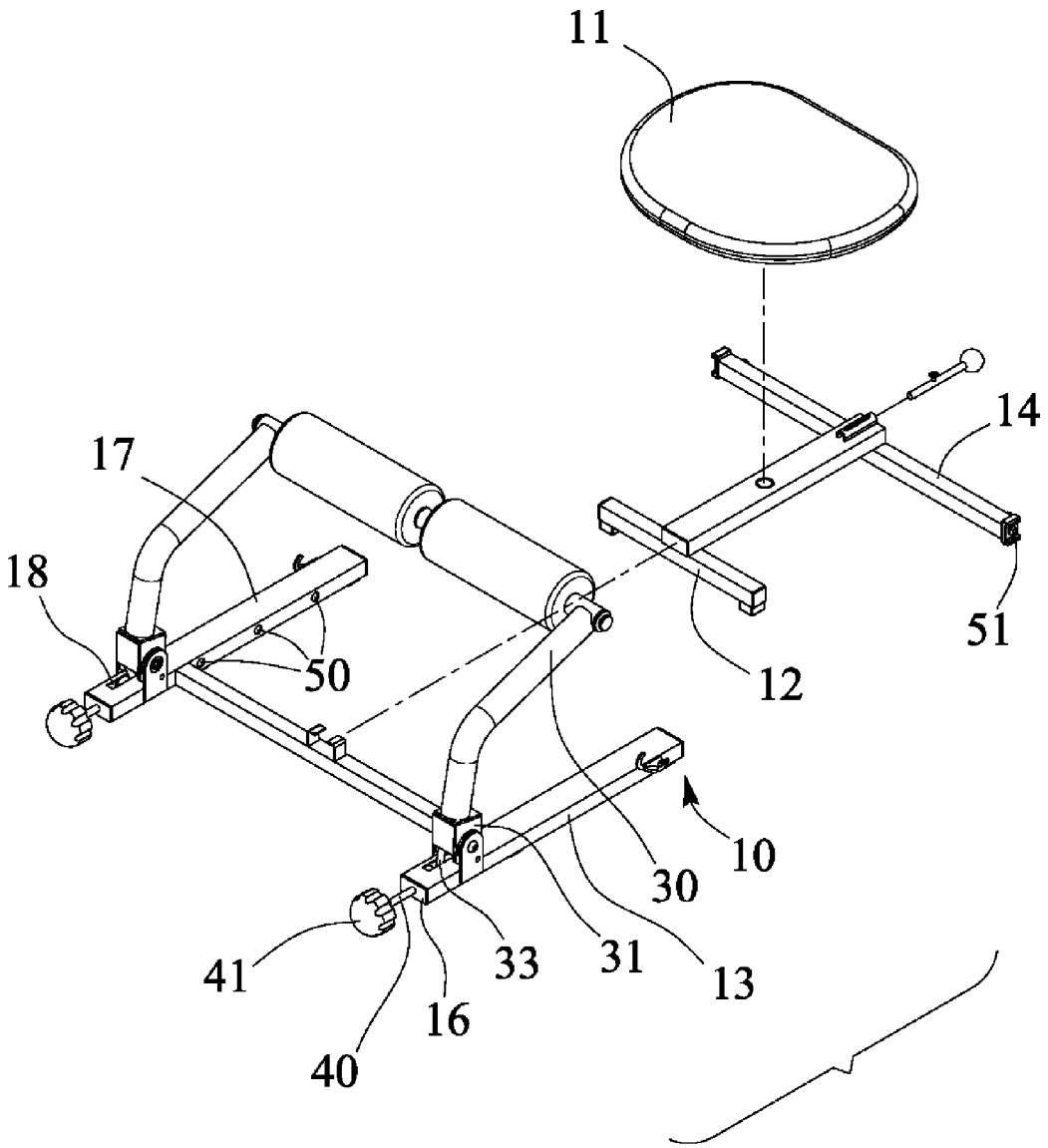
FIG. 6 is another partial exploded view as seen from the upper portion of the abdominal exercising device.
Figure 7:
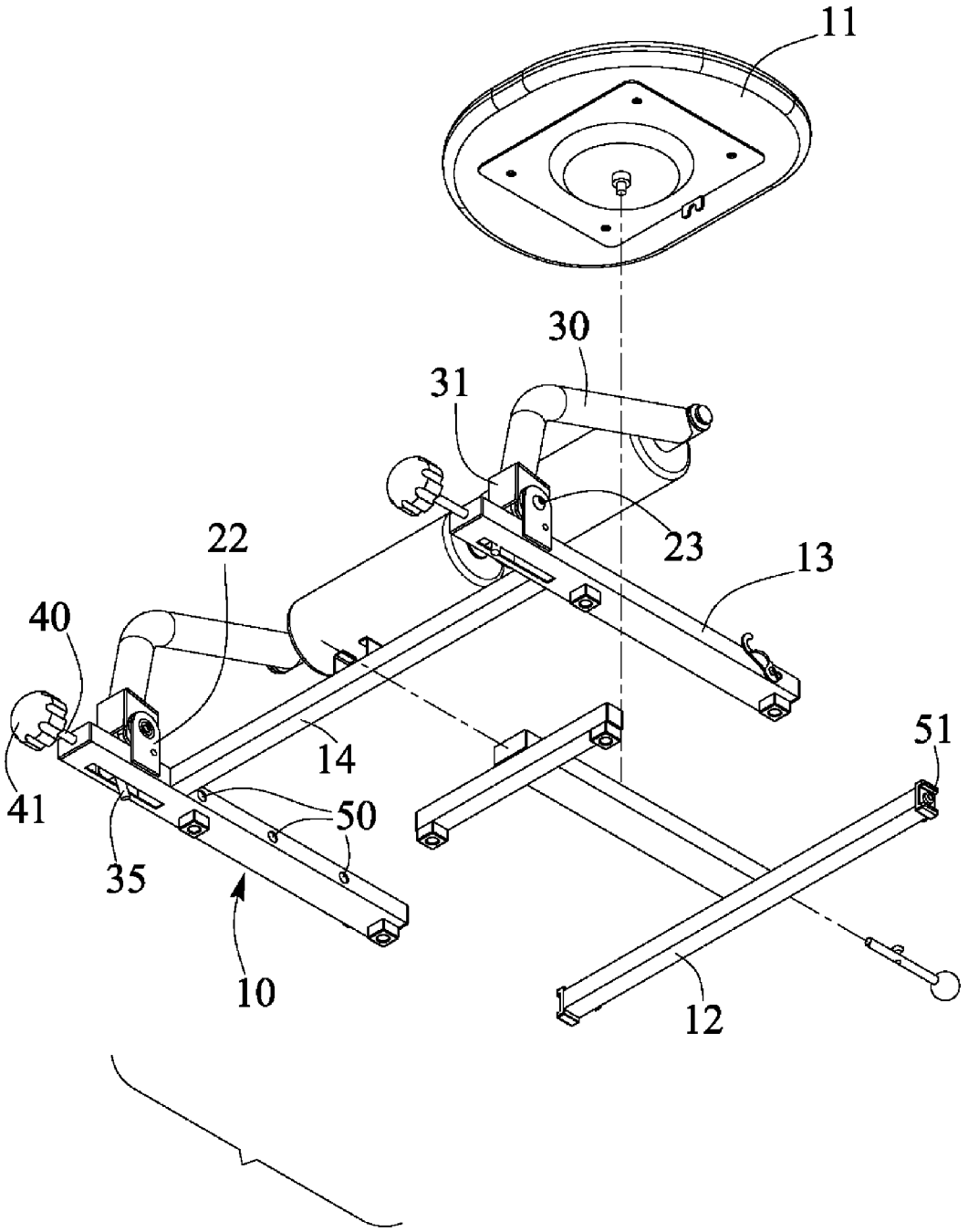
FIG. 7 is a further partial exploded view as seen from the bottom portion of the abdominal exercising device.

In operation, as shown in FIGS. 4 and 5, the adjusting members 40 may be forced and moved forwardly and rearwardly relative to the base supporting member 10 with the knobs 41 in order to force and move the followers 20 and the other or second legs 35 of the spring biasing members 33 forwardly and rearwardly relative to the base supporting member 10 respectively, so as to adjust the spring biasing force of the spring biasing members 33 applied onto the handles 30 and thus for allowing the user of different sizes or dimensions or heights or strengths to pivot or rotate or swing the handles 30 relative to the base supporting member 10, and thus for suitably actuating or operating the abdominal exercising device, and thus for allowing the user to suitably conduct or operate various kinds of exercises or operations. The abdominal exercising device includes a simplified structure that may be made or manufactured with a greatly decreased manufacturing cost.

As shown in FIGS. 1-3 and 6-7, the beams 13 of the base supporting member 10 each include one or more orifices 50 formed therein, such as formed in the inner portion of the beam 13, and the orifices 50 of the beams 13 are faced or directed toward each other, and the base frame 12 includes two opposite spring biasing latches 51 provided thereon for selectively engaging with either pair of the orifices 50 of the beams 13 and for movably or adjustably attaching or mounting or securing the base frame 12 and the seat element 11 to the base supporting member 10 at the selected or required position or location and thus for allowing the user of different sizes or dimensions or heights to suitably actuate or operate the handles 30 relative to the base supporting member 10.

Accordingly, the abdominal exercising device in accordance with the present invention includes a structure or configuration for the disable persons to comfortably rehabilitate or exercise their abdominal portion or other muscle groups and including a simplified structure or configuration that may be made or manufactured with a simplified manufacturing procedure and a decreased manufacturing cost.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An abdominal exercising device comprising: a base supporting member having side portions and including a seat element for supporting a user, and including two beams provided on said side portions, two handles each including a lower portion rotatably attached to said base supporting member with a pivot shaft for allowing said handles to be rotated relative to said base supporting member, two spring biasing members engaged with and engaged between said handles and said base supporting member for applying a spring biasing force to said handles and for resisting a rotational movement of said handles relative to said base supporting member, and two adjusting members engaged with said beams of said base supporting member respectively and engageable with said spring biasing members for adjusting said spring biasing members relative to said base supporting member and said handles; said spring biasing members each include a first leg engaged with said handle and a second leg extended into said beams of said base supporting member; wherein said beams of said base supporting member each include a groove formed therein for slidably receiving and engaging with said respective second leg of said spring biasing members.

2. The abdominal exercising device as claimed in claim 1, wherein said base supporting member includes two followers slidably engaged in said beams and engaged with said second legs of said spring biasing members respectively, said adjusting members are engaged with said followers respectively.

3. The abdominal exercising device as claimed in claim 2, wherein said followers each include at least one guiding member attached to said followers for guiding and limiting said followers to slide or move relative to said beams respectively.

4. The abdominal exercising device as claimed in claim 1, wherein said adjusting members each include a knob provided thereon for rotating said adjusting member relative to said beam.

5. The abdominal exercising device as claimed in claim 1, wherein said beams of said base supporting member each include a cap provided thereon, and said adjusting members are threaded and engaged with said caps of said beams of said base supporting member respectively.

6. The abdominal exercising device as claimed in claim 1, wherein said beams of said base supporting member each include two ears attached to said beam and extended beyond said beam for supporting said pivot shaft thereon, and said bottom portion of said handle is attached to said pivot shaft.

7. The abdominal exercising device as claimed in claim 1, wherein said base supporting member includes a base frame adjustably supported on the base supporting member for supporting the seat element.

* * * * *